US009601058B2

(12) United States Patent
Lee et al.

(10) Patent No.: US 9,601,058 B2
(45) **Date of Patent: *Mar. 21, 2017**

(54) ORGANIC LIGHT EMITTING DIODE DISPLAY DEVICE AND DRIVING METHOD THEREOF

(71) Applicant: LG DISPLAY CO., LTD., Seoul (KR)

(72) Inventors: Byung Jae Lee, Paju-si (KR); Jun Hyeok Yang, Paju-si (KR); Tae Gung Kim, Paju-si (KR); Myung Gi Lim, Ansan-si (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 15/169,082

(22) Filed: May 31, 2016

(65) Prior Publication Data

US 2016/0275871 A1 Sep. 22, 2016

Related U.S. Application Data

(63) Continuation of application No. 14/945,866, filed on Nov. 19, 2015, now Pat. No. 9,378,678.

(30) Foreign Application Priority Data

Dec. 31, 2014 (KR) ..... 10-2014-0195821

(51) Int. Cl.

| | |
|---|---|
| ***G09G 3/3291*** | (2016.01) |
| ***G09G 3/32*** | (2016.01) |
| ***G09G 3/20*** | (2006.01) |

(52) U.S. Cl.

CPC ..... *G09G 3/3291* (2013.01); *G09G 3/2003* (2013.01); *G09G 3/2007* (2013.01); *G09G 3/3233* (2013.01); *G09G 3/3266* (2013.01); *G09G 2300/0819* (2013.01); *G09G 2300/0842* (2013.01); *G09G 2310/0262* (2013.01); *G09G 2320/029* (2013.01); *G09G 2320/0233* (2013.01); *G09G 2320/0242* (2013.01); *G09G 2320/0285* (2013.01); *G09G 2320/0295* (2013.01); *G09G 2320/043* (2013.01);

(Continued)

(58) Field of Classification Search

CPC ..... G09G 3/3233; G09G 3/3648

See application file for complete search history.

(56) References Cited

U.S. PATENT DOCUMENTS

| | | | |
|---|---|---|---|
| 2002/0021293 | A1 | 2/2002 | Tam |
| 2004/0017336 | A1 | 1/2004 | Chang |

(Continued)

*Primary Examiner* — Ricardo L Osorio

(74) *Attorney, Agent, or Firm* — Dentons US LLP

(57) ABSTRACT

An OLED display device is disclosed which includes: a display panel configured with pixels which each include an organic light emitting diode and a driving transistor applying a driving current to the organic light emitting diode; a gate driver connected to the pixels through gate lines; a data driver configured to apply a sensing voltage to the pixels through data lines in a sensing mode and enable a sensing current to flow through each of the driving transistors; a sensing driver configured to sense threshold voltages opposite the driving currents which flow through the driving transistors; and a brightness compensation circuit configured to derive negatively shifted degrees of threshold voltages of the driving transistors from the sensed threshold voltages, detect a bright-defected pixel on the basis of the negatively shifted degrees, and generate a compensation gray value for the bright-defected pixel.

15 Claims, 9 Drawing Sheets

(52) U.S. Cl.
CPC ... *G09G 2320/045* (2013.01); *G09G 2330/08* (2013.01); *G09G 2360/16* (2013.01)

(56) References Cited

U.S. PATENT DOCUMENTS

| | | | |
|---|---|---|---|
| 2005/0083270 | A1 | 4/2005 | Miyazawa |
| 2011/0227505 | A1 | 9/2011 | Park |
| 2012/0086694 | A1 | 4/2012 | Tseng |
| 2013/0016135 | A1 | 1/2013 | Wang |
| 2013/0169516 | A1 | 7/2013 | Chen |
| 2013/0207957 | A1 | 8/2013 | Lin |
| 2014/0253603 | A1 | 9/2014 | Kwon |
| 2015/0001504 | A1 | 1/2015 | Kim |
| 2015/0138183 | A1 | 5/2015 | Kishi |

| | 1st example | 2nd example | 3rd example |
|---|---|---|---|
| Amount before compensation | Small | Middle | large |
| Amount after compensation | None | Small | Small or Middle |
| Detected and compensated number | W : 16ea<br>G : 18ea | W : 510ea<br>G : 597ea | W : 1,870ea<br>G : 2,353ea |

ORGANIC LIGHT EMITTING DIODE DISPLAY DEVICE AND DRIVING METHOD THEREOF

The present application is a continuation of U.S. patent application Ser. No. 14/945,866 filed Nov. 19, 2015, now allowed, which claims priority under 35 U.S.C. §119(a) of Korean Patent Application No. 10-2014-0195821 filed on Dec. 31, 2014, both of which are hereby incorporated by reference for all purposes in their entirety.

BACKGROUND OF THE INVENTION

Field of the Disclosure

The present application relates to an organic light emitting diode (OLED) display device. More particularly, the present application relates to an OLED display device and a driving method thereof adapted to prevent a brightness defect, such as a bright spot, using negatively shifted threshold voltage information of a driving transistor.

Discussion of the Related Art

As the information society spreads, the importance of flat panel display devices with features such as slimness, light weight, low power consumption and so on are being increased. The flat panel display devices include liquid crystal display (LCD) devices and OLED display devices which each include thin film transistors and have advantages of high definition, full color display, superior image quality and so on. The LCD devices and the OLED display devices are being applied to a variety of appliances such as television receivers, tablet computers, desk-top computer and so on. Particularly, the OLED display devices are being spotlighted as a next generation flat panel display device because of having high response speed, low power consumption, a self-luminous property and a wide viewing angle.

The OLED display device includes driving transistors (more specifically, driving thin film transistor) disposed pixels. The driving transistors must have different properties, such as threshold voltage Vth and mobility, due to a process deviation and so on.

FIG. 1 illustrates a negative shift phenomenon of a threshold voltage Vth of a driving transistor disposed on an OLED display device of the related art. FIG. 2 illustrates degrees of bright spot defects which are caused by negatively shifted degree of threshold voltages of driving transistors. FIG. 3 illustrates bright spots generated on the related art OLED display device which is displayed at a low gray level.

As shown in FIG. 1, the driving transistors used in the related art OLED display device can have negatively shifted threshold voltages NG from reference threshold voltages Ref due to a process deviation and foreign substances on driving transistor regions. The negatively shifted threshold voltage of the driving transistor can vary a driving current of an organic light emitting element of a pixel. Due to this, a bright defect can be generated in some pixels.

The bright defect can have one of brightness properties which are represented by first and second bright spot of FIG. 2 and depend on negatively shifted degrees of the threshold voltages.

Such bright defects can be displayed as bright spots, which have a higher brightness that those of adjacent spots thereto, and form yellow circles shown in FIG. 3, when the OLED display device is driven in a low gray level. In other words, stains and undesired patterns must be continuously displayed on the OLED device due to the bright defect.

In this manner, the process deviation and the foreign substance cause the bright defects by shifting the threshold voltage of the driving transistor of the related art OLED display device. Nevertheless, only one of changing and cleaning operations is performed to equipments, which are used in the fabrication of the OLED display device, without any method of removing the bright defect.

SUMMARY OF THE INVENTION

Accordingly, embodiments of the present application are directed to an OLED display device and a driving method thereof that substantially obviate one or more of problems due to the limitations and disadvantages of the related art, as well to a light source module and a backlight unit each using the same.

The embodiments provide an OLED display device and a driving method thereof which are adapted to enhance the detection probability of bright-defected pixels by comparing the threshold voltages Vth of driving transistors, which are sensed in adjacent pixels to one another, and detecting the bright-defected pixels.

Also, the embodiments provide an OLED display device and the driving method thereof which are adapted to prevent the deterioration of brightness at a bright-defected pixel and normal pixels adjacent thereto by generating a compensation gray value for the bright-defected pixel and applying the compensation gray value to the bright-defected pixel.

Additional features and advantages of the embodiments will be set forth in the description which follows, and in part will be apparent from the description, or may be learned by practice of the embodiments. The advantages of the embodiments will be realized and attained by the structure particularly pointed out in the written description and claims hereof as well as the appended drawings.

In order to solve the problems of the related art, an OLED display device according to a general aspect of the present embodiment includes: a display panel configured with pixels which each include an organic light emitting diode and a driving transistor applying a driving current to the organic light emitting diode; a gate driver connected to the pixels through gate lines; a data driver configured to apply a sensing voltage to the pixels through data lines in a sensing mode and enable a sensing current to flow through each of the driving transistors; a sensing driver configured to sense threshold voltages opposite the driving currents which flow through the driving transistors; and a brightness compensation circuit configured to derive negatively shifted degrees of threshold voltages of the driving transistors from the sensed threshold voltages, detect a bright-defected pixel on the basis of the negatively shifted degrees, and generate a compensation gray value for the bright-defected pixel. As such, the OLED display device can generate the compensation gray value for the bright-defected pixel and apply the compensation gray value to the bright-defected pixel. In accordance therewith, the deterioration of brightness at the bright-defected pixel and the normal pixels adjacent thereto can be prevented.

A driving method of an OLED display device according to another general aspect of the present embodiment is applied to an organic light emitting diode display device which includes pixels each configured with an organic light emitting diode and a driving transistor applying a driving current to the organic light emitting diode. The method includes: enabling driving currents to flow through the driving transistors by applying a sensing voltage to the pixels through data lines in a sensing mode; sensing threshold voltages opposite the driving currents which flow through the driving transistors; deriving negatively shifted degrees of threshold voltages of the driving transistors from the sensed threshold voltages; detecting a bright-defected pixel on the basis of the negatively shifted degrees of the threshold voltages of the driving transistors; and generating a compensation gray value for the bright-defected pixel. As such, the driving method of the OLED display device can generate the compensation gray value for the bright-defected pixel and apply the compensation gray value to the bright-defected pixel. In accordance therewith, the deterioration of brightness at the bright-defected pixel and the normal pixels adjacent thereto can be prevented.

Other systems, methods, features and advantages will be, or will become, apparent to one with skill in the art upon examination of the following figures and detailed description. It is intended that all such additional systems, methods, features and advantages be included within this description, be within the scope of the present disclosure, and be protected by the following claims. Nothing in this section should be taken as a limitation on those claims. Further aspects and advantages are discussed below in conjunction with the embodiments. It is to be understood that both the foregoing general description and the following detailed description of the present disclosure are exemplary and explanatory and are intended to provide further explanation of the disclosure as claimed.

BRIEF DESCRIPTION OF THE DRAWINGS

The accompanying drawings, which are included to provide a further understanding of the embodiments and are incorporated herein and constitute a part of this application, illustrate embodiment(s) of the present disclosure and together with the description serve to explain the disclosure. In the drawings.

DETAILED DESCRIPTION OF THE EMBODIMENTS

Figure 1:
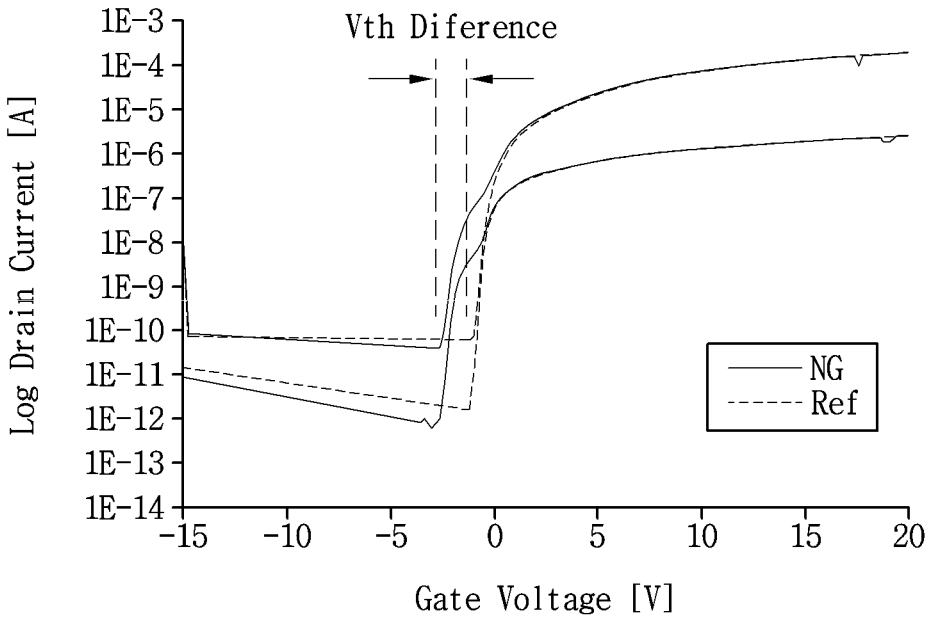
FIG. 1 (Related Art)
FIG. 1 illustrates a negative shift phenomenon of a threshold voltage Vth of a driving transistor disposed on an OLED display device of the related art.

Advantages and features of the present disclosure, and implementation methods thereof will be clarified through the following embodiments described with reference to the accompanying drawings. These embodiments introduced hereinafter are provided as examples in order to convey their spirits to the ordinary skilled person in the art. As such, these embodiments might be embodied in a different shape, so are not limited to these embodiments described here. Therefore, the present disclosure must be defined by scopes of claims.

In the following description, numerous specific details are set forth, such as particular structures, sizes, ratios, angles, coefficients and so on, in order to provide an understanding of the various embodiments of the present disclosure. However, it will be appreciated by one of ordinary skill in the art that the various embodiments of the present disclosure may be practiced without these specific details. The same reference numbers will be used throughout this disclosure to refer to the same or like parts. In other instances, well-known technologies have not been described in detail in order to avoid obscuring the present disclosure.

It will be further understood that the terms "comprises", "comprising,", "has", "having", "includes" and/or "including", when used herein, specify the presence of stated features, integers, steps, operations, elements, and/or components, but do not preclude the presence or addition of one or more other features, integers, steps, operations, elements, components, and/or groups thereof. As used herein, the singular forms "a", "an" and "the" are intended to include the plural forms as well, unless the context clearly indicates otherwise.

Elements used in the present disclosure without additional specific details must be considered to include tolerance.

In the description of embodiments, when a structure is described as being positioned "on or above" or "under or below" another structure, this description should be construed as including a case in which the structures contact each other as well as a case in which a third structure is disposed therebetween.

The temporal terms of "after", "subsequently", "next", "before" and so on used in this disclosure without specifying "immediately" or "directly" can include other discontinuously temporal relations.

Moreover, although some of the elements are designated with numerical terms (e.g., first, second, third, etc.), it should be understood that such designations are only used to specify one element from a group of similar elements, but not to limit the element in any specific order. As such, an element designated as a first element could be termed as a second element or as third element without departing from the scope of exemplary embodiments.

The features of various exemplary embodiments of the present disclosure may be partially or entirely bound or combined with each other, and be technically engaged and driven using various methods as apparent to those skilled in the art, and the exemplary embodiments may be independently practiced alone or in combination.

Reference will now be made in detail to the embodiments of the present disclosure, examples of which are illustrated in the accompanying drawings. Also, the size and thickness of the device might be expressed to be exaggerated for the sake of convenience in the drawings. Wherever possible, the same reference numbers will be used throughout this disclosure including the drawings to refer to the same or like parts.

Figure 4:
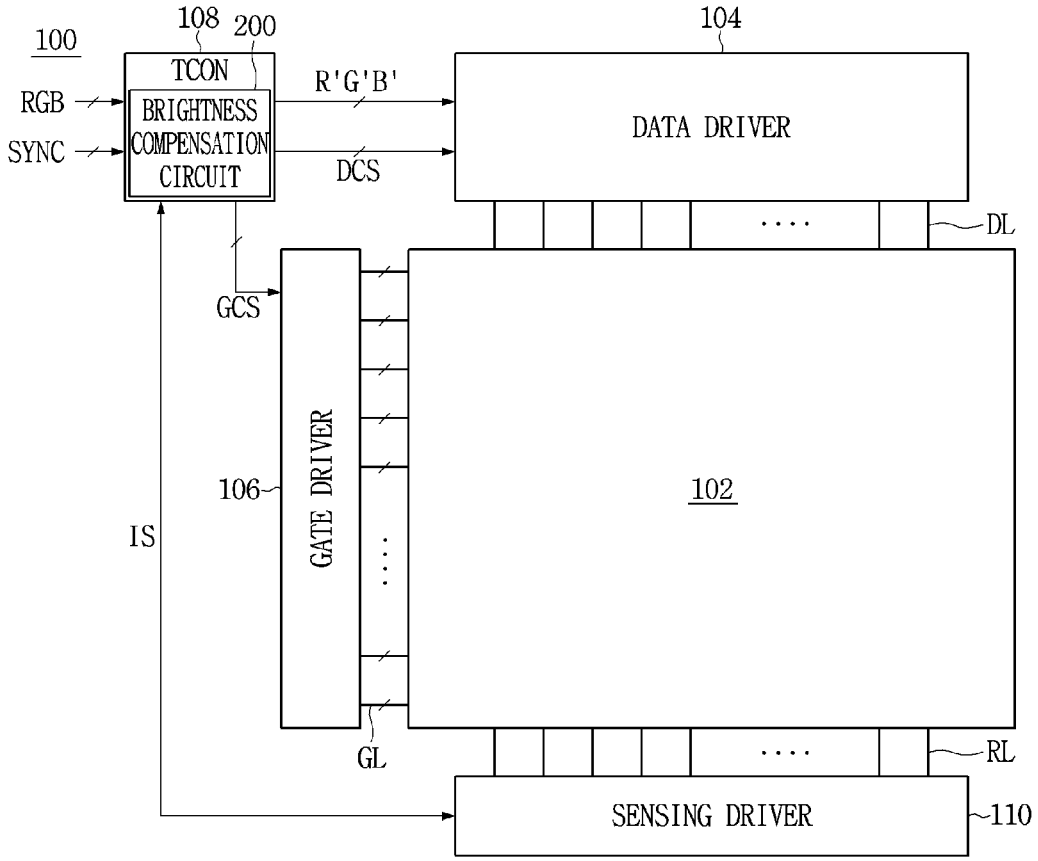
FIG. 4 is a block diagram showing a configuration of an OLED display device according to an embodiment of the present disclosure.
Figure 5:
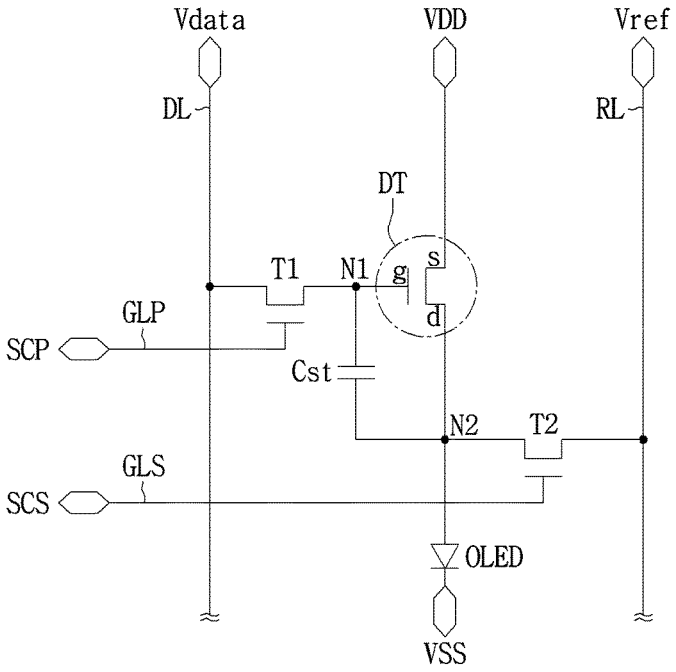
FIG. 5 is a circuit diagram showing a pixel and a part of a sensing driver on an OLED display device according to an embodiment of the present disclosure.

FIG. 4 is a block diagram showing the configuration of an OLED display device according to an embodiment of the present disclosure. FIG. 5 is a circuit diagram showing a pixel and a part of a sensing driver on an OLED display device according to an embodiment of the present disclosure.

Referring to FIGS. 4 and 5, an OLED display device 100 includes a display panel 102, a data driver 104, a gate driver 106, a sensing driver 110, a timing controller 108 and a brightness compensation unit 200.

The OLED display device 100 according to the present disclosure can be divisionally driven in a manner of distinguishing a sensing mode and a display mode from each other. The sensing mode can be performed to sense (or detect) a threshold voltage Vth of a driving transistor DT of each pixel. In the display mode, the OLED display device can perform brightness compensation and image display using sensed negative shift information ΔVth for the threshold voltage ΔVth of the driving transistor DT.

The display panel 102 includes a plurality of gate lines GL and a plurality of data line DL. Also, the display panel 102 includes first voltage supply lines VDD, second voltage supply lines VSS and reference voltage supply line RL. The high voltage supply lines, the low voltage supply lines VSS and the reference voltage supply lines are connected to pixels.

Such a display panel 102 is defined into pixel regions by the pluralities of gate lines GL and data lines DL. The display panel 102 includes a disposed on each of the pixel regions. The pixel includes an organic light emitting diode OLED and a pixel driver configured to drive the organic light emitting diode OLED. The gate lines GL of the display panel 102 each include primary and secondary gate lines GLP and GLS (shown FIG. 5) which are connected to each of the pixels. The OLED display device 100 of the present disclosure senses a threshold voltage of a driving transistor DT included in each of the pixel and compensates for brightness on the basis of a negative shift degree of the threshold voltage Vth. As such, the OLED display device 100 can enhance image quality. The brightness compensation method using the negative shift degree of the threshold voltage of the driving transistor DT included in each of the voltage-sensible pixel will be described in detail later.

The data driver 104 is controlled by data control signals DCS applied from the timing controller 108. In the display mode, the data driver 104 latches image data R'G'B' applied from the timing controller 108 and converts the latched image data R'G'B' into data voltages Vdata using gamma voltages. The converted data voltages Vdata are simultaneously transferred from the data driver 104 to the plurality of data lines DL. Also, the data driver 104 applies sensing voltages Vsen to the plurality of data lines DL in the sensing mode.

The sensing voltage Vsen on the data line DL is applied to a gate electrode ('g' in FIG. 5) of the driving transistor DT. As such, a sensing current flows through the driving transistor DT. In accordance therewith, a negative shift degree of the threshold voltage Vth of the driving transistor DT can be sensed (or detected) on the sensing current flowing through the driving transistor DT.

The gate driver 106 is controlled by gate control signals GCS applied from the timing controller 108. Also, the gate driver 106 generates primary and secondary scan signals SCP and SCS and applies the primary and secondary scan signals SCP and SCS to the primary and secondary gate lines GLP and GLS.

In the sensing mode, the primary and secondary scan signals SCP and SCS being transferred to the primary and secondary gate lines GLP and GLS can each have a gate-on voltage level VGH. Also, the primary and secondary scan signals SCP and SCS being transferred to the primary and secondary gate lines GLP and GLS in the display mode can each have the gate-on voltage level VGH.

The timing controller 108 re-arranges a frame unit of externally input image data RGB and applies re-arranged image data R'G'B' to the data driver 104. Also, the timing controller 108 derives the gate control signals GCS and the data control signals DCS from externally input timing synchronous signals SYNC. Moreover, the timing controller 108 controls the data driver 104 and the gate driver 106 by applying the data control signals DCS and the gate control signals GCS to the data driver 104 and the gate driver 106.

The timing synchronous signals can include a vertical synchronous signal Vsync, a horizontal synchronous signals Hsync, a data enable signal DE, a dot clock signal DCLK and so on. The gate control signals GCS can include a gate start pulse GSP, a gate shift clock signal GSC, a gate output enable signal GOE and so on. The data control signals can include a source start pulse SSP, a source sampling clock signal SSC, a source output enable signal SOE and so on.

Figure 6:
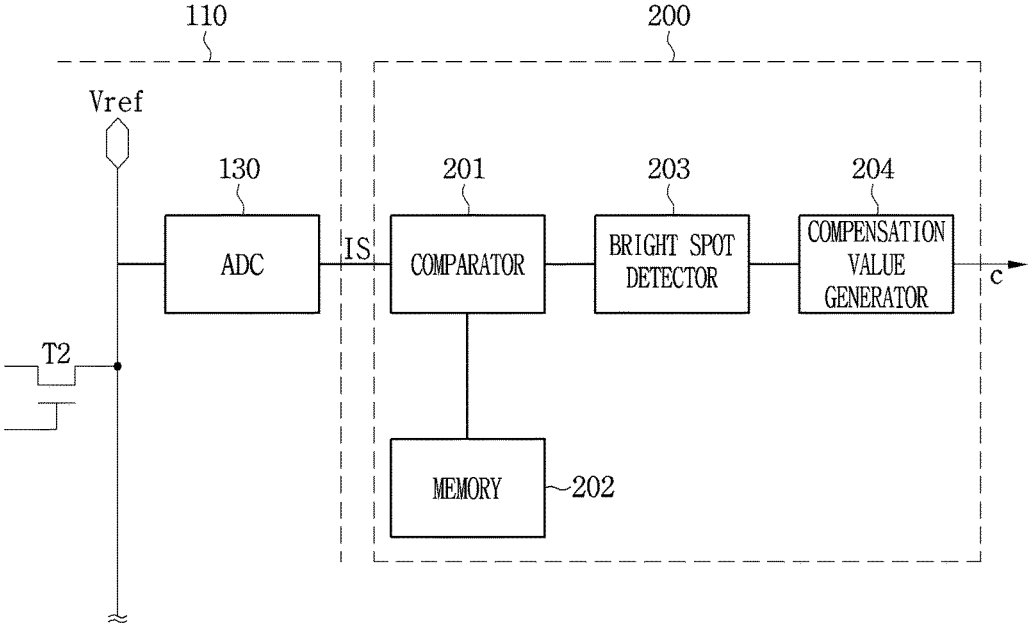
FIG. 6 is a detailed block diagram showing configurations of a sensing driver and a brightness compensation circuit according to an embodiment of the present disclosure.

The sensing driver 110 can include a second switching transistor T2 disposed in each of the pixel regions and an analog-to-digital converter 130 (hereinafter, 'ADC 130') connected to the second switching transistor T2 through the reference voltage supply line RL, as shown in FIG. 6.

The sensing driver 110 detects the threshold voltage Vth of the driving transistor DT by sensing information (i.e., a voltage) opposite to the sensing current using the reference voltage supply line RL. Also, the sensing driver 110 converts the detected threshold voltage Vth into an information signal IS (or a digital signal) and applies the information signal IS including the detected threshold voltage Vth to the brightness compensation circuit 200 which is disposed in the timing controller 108.

The reference voltage supply line RL is used to transfer a reference voltage Vref to each of the pixels. To this end, the reference voltage supply line RL is connected to each of the pixels. In the sensing mode, the reference voltage supply line RL can be used as a sensing line which allows the sensing driver 110 to measure the sensing current flowing through the driving transistor DT.

The pixel of the present disclosure is connected to the primary and secondary gate lines GLP and GLS, the data line DL, the first voltage supply line VDD, the second voltage supply line VSS and the reference voltage line RL. The first voltage supply line VDD can be used to transfer a high voltage to each of the pixels, and the second voltage supply line VSS can be used to transfer a low voltage to each of the pixel.

As shown in FIG. 5, each of the pixels includes an organic light emitting diode OLED, first and second switching transistors T1 and T2, a driving transistor DT and a storage capacitor Cst.

The organic light emitting diode OLED and the driving transistor DT are serially connected between the first voltage supply line VDD and the second voltage supply line VSS. In detail, the organic light emitting diode OLED includes an anode electrode connected to the driving transistor DT, a cathode electrode connected to the second voltage supply line VSS, and a emission layer interposed between the anode electrode and the cathode electrode.

The emission layer includes an electrode injection layer, an electron transport layer, an organic emission layer, a hole transport layer and a hole injection layer which are stacked between the anode and cathode electrodes. If a positive bias voltage is applied between the anode and cathode electrodes, not only electrons are applied from the cathode electrode to the organic emission layer through the electron injection layer and the electron transport layer but also holes are applied from the anode electrode to the organic emission layer through the hole injection layer and the hole transport layer. Then, the electrons and the holes applied to the organic emission layer are re-combined with each other. As such, a fluorescent or phosphorescent material forming the organic emission layer emits light. In accordance therewith, brightness being in proportion to a current density is generated.

The first switching transistor T1 switches a current path between the data line DL with a first node N1 in response to the primary scan signal SCP applied from the primary gate line GLP. The first node N1 is connected with the gate electrode 'g' of the driving transistor DT.

The second switching transistor T2 switches a current path between a second node N2 and the sensing line RL in response to the secondary scan signal SCS applied from the secondary gate line GLS. The sensing line RL is the reference voltage supply line RL as described above. The second node N2 is connected with a second electrode 'd' of the driving transistor DT.

The driving transistor DT includes the gate electrode 'g' connected to the first node N1, a first electrode 's' connected to the first voltage supply line VDD, and the second electrode 'd' connected to the anode electrode through the second node N2.

The driving transistor DT applies a driving current to the second node N2 according to a voltage state of the first node N1. The first and second electrode 's and d' of the driving transistor DT can become source and drain electrodes or drain and source electrodes according to the direction of the driving current.

In the OLED display device of the present disclosure, the sensing driver 110 detects the threshold voltage Vth of the driving transistor DT by sensing the driving current which flows through the driving transistor DT.

The detected threshold voltage Vth of the driving transistor DT is converted into the shape of the information signal IS and then applied from the sensing driver 110 to the brightness compensation circuit 200. The brightness compensation circuit 200 detects bright-defected pixels, such as bright spots, using the sensed threshold voltage information Vth.

Also, the brightness compensation circuit 200 generates compensation gray values in order to compensate gray values which will be applied to the bright-defected pixels. The compensation gray values are applied to the bright-defected pixels when the OLED display device 100 is driven in the display mode. In accordance therewith, image quality of the OLED display device 100 can be enhanced.

In this manner, the OLED display device and the driving method thereof according to the present disclosure can detect the bright-defected pixels by comparing the sensed threshold voltages Vth of the driving transistors TM of adjacent pixels to one another. In accordance therewith, a detection probability of the bright-defected pixel can become higher.

Also, the OLED display device and the driving method thereof according to the present disclosure generate compensation gray values for the bright-defected pixels and apply the compensation gray values to the bright-defected pixels. As such, the deterioration of brightness at the bright-defected pixel and the normal pixel adjacent thereto can be prevented.

Figure 7:
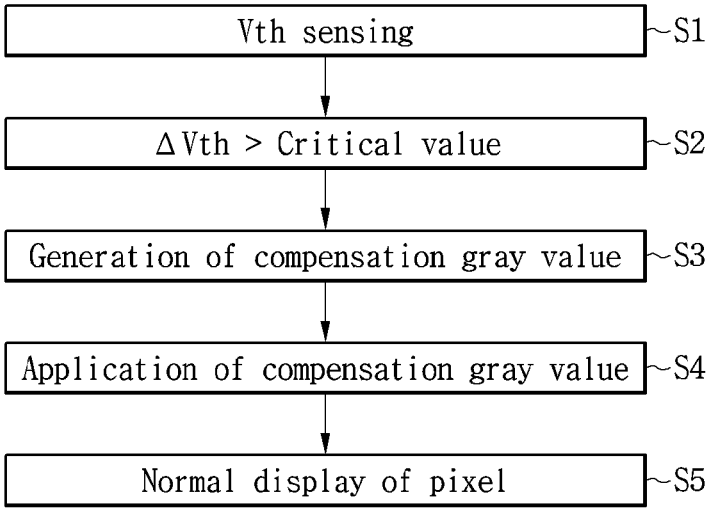
FIG. 7 is a flowchart illustrating a driving method of the OLED display device with a brightness compensation function according to an embodiment of the present disclosure.

FIG. 6 is a detailed block diagram showing configurations of a sensing driver and a brightness compensation circuit according to an embodiment of the present disclosure. FIG. 7 is a flowchart illustrating a driving method of the OLED display device with a brightness compensation function according to an embodiment of the present disclosure.

Referring to FIGS. 5, 6 and 7, the present disclosure detects the bright-defected pixels using the sensed threshold voltage information Vth of the driving transistors DT. Also, the present disclosure compensates the gray values of the bright-defected pixels instead of the threshold voltages Vth of the driving transistors DT. In accordance therewith, the present disclosure can enable the bright-defected pixels to have the same brightness as the normal pixels.

In other words, the present disclosure allows a fixed bright-defected pixel to have a largely lowered brightness value through the compensation process. As such, the fixed bright-defected pixel can realize the same brightness as the normal pixel.

As shown in the drawings, a sensed current signal is converted into a voltage signal and applied to the ADC 130 through the sensing line RL as a sensed threshold voltage Vth. The ADC 130 converts the sensed threshold voltage into a digital information signal IS and applies the converted information signal IS to the brightness compensation circuit 200 which is disposed in the timing controller 108. (First step S1 in FIG. 7)

The brightness compensation circuit 200 can include a comparator 201, a memory 202, a bright spot detector 203 and a compensation value generator 204.

The information signal IS including the threshold voltage information Vth of the driving transistors DT is applied to the comparator 201 of the brightness compensation circuit 200. As such, the comparator 201 can extract the pixels, which each have threshold voltages more than a fixed value, by comparing the sensed threshold voltages Vth of the pixels. For example, the sensed threshold voltages Vth of an arbitrary pixel and adjacent pixels thereto can be compared with one another. Alternatively, the sensed threshold voltages Vth of the pixels can be filtered by a high pass filter.

Also, the comparator 201 compares the extracted threshold voltages Vth with a reference threshold voltage Ref stored in the memory 202. In accordance therewith, a negatively shifted degree ΔVth of the sensed threshold voltage Vth with respect to the reference threshold voltage Ref can be detected by the comparator 201.

Figure 2:
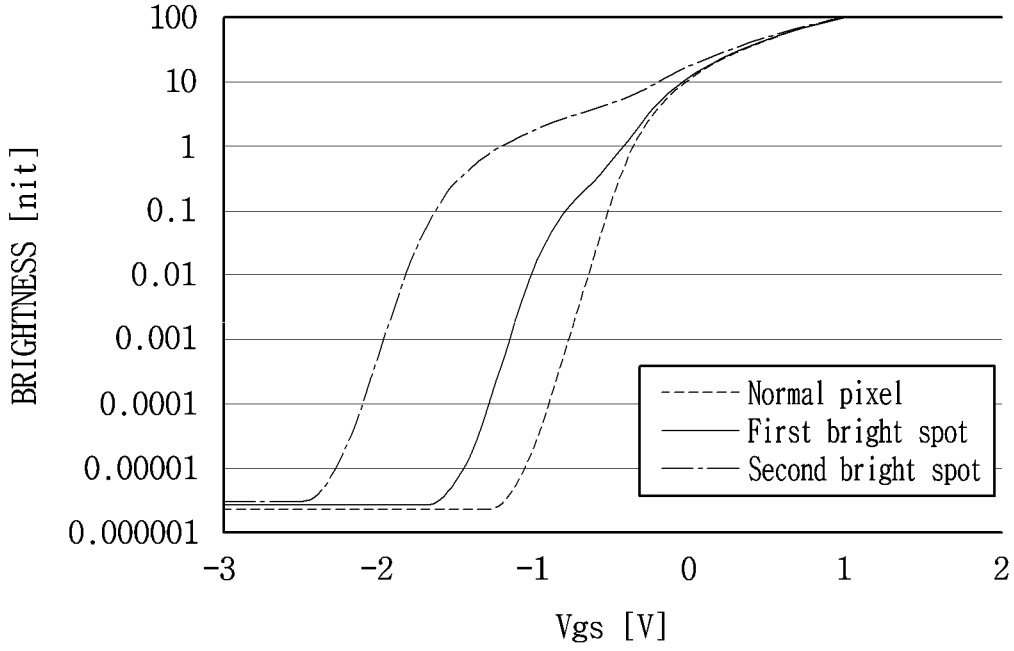
FIG. 2 (Related Art)
FIG. 2 illustrates degrees of bright spot defects which are caused by negatively shifted degree of threshold voltages of driving transistors.
Figure 3:
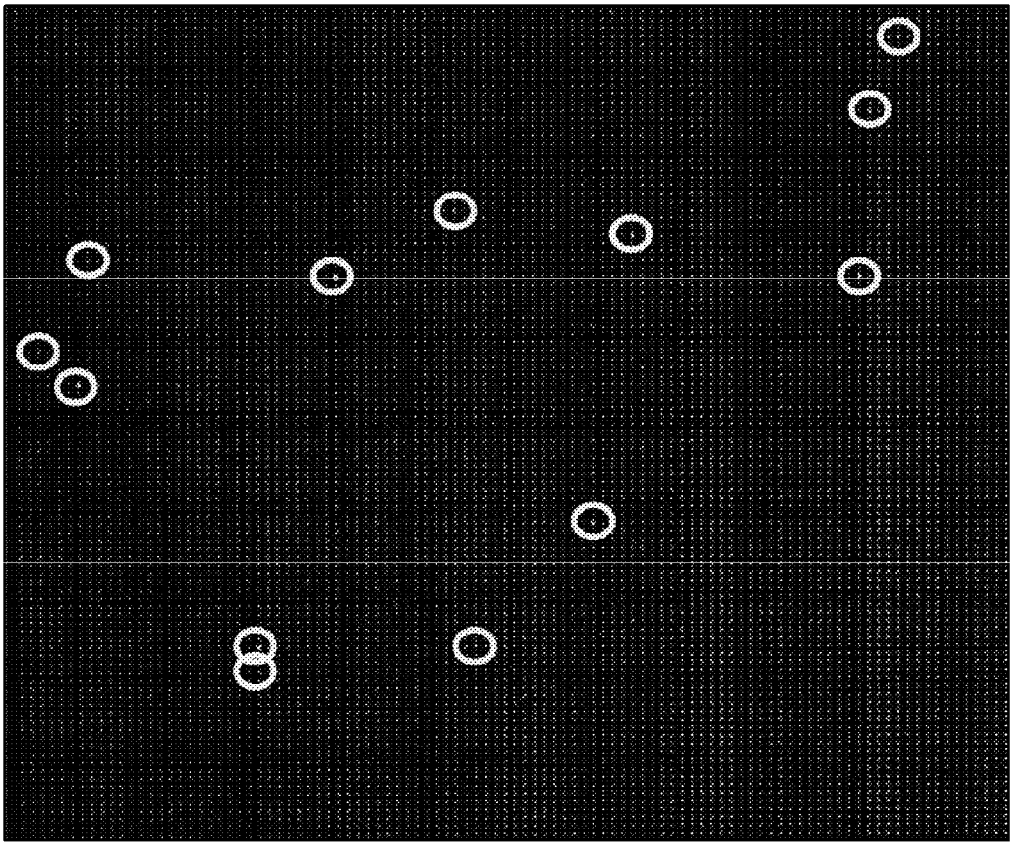
FIG. 3 (Related Art)
FIG. 3 shows bright spots generated on the related art OLED display device which is displayed at a low gray level.

The negatively shifted degree ΔVth of the sensed threshold voltage Vth is compared with a critical value by the bright spot detector 203. As such, the bright spot detector 203 can detect a pixel, which has the negatively shifted degree ΔVth more than the critical value, as the bright-defected pixel. (Second step S2 in FIG. 2)

The detection resultant of the bright-defected pixel is applied from the bright spot detector 203 to the compensation value generator 204. When the bright-defected pixel is detected, the compensation value generator 204 generates a compensation gray value Gray_out for the bright-defected pixel using the following equation 1.

$$\text{Gray_out}=\text{COEF1}\times\text{Gray_In}+\text{COEF2}\times f(\Delta Vth)+\text{COEF3} \quad \text{Equation 1}$$

In the equation 1, 'COEF1', 'COEF2' and 'COEF3' are first through third compensation coefficients, 'Gray_In' is an input gray value applied to the respective pixel before the compensation, and 'ΔVth' is a negatively shifted degree. In other words, 'ΔVth' is a deviation of the threshold voltage Vth.

The first through third compensation coefficients COEF1, COEF2 and COEF3 are used in a calculation of the compensation gray value and enable the bright-defected pixel to be display in the same brightness as the normal pixels. Also, the first through third compensation coefficients COEF1, COEF2 and COEF3 can each be previously set in a manner of varying with the negatively shifted degree ΔVth and the input gray value 'Gray_in'. As such, pluralities of first compensation coefficients COEF1, second compensation coefficients COEF2 and third compensation coefficients COEF3 in accordance with detectable negatively-shifted-degrees and the number of gray levels of the input gray value 'Gray_In' can be prepared.

Such compensation coefficients COEF1, COEF2 and COEF3 can be prepared in a look-up table and stored in the memory 202. As such, when a bright-defected pixel is detected by the bright spot detector 203, the compensation value generator 204 can use the compensation coefficient look-up table stored in the memory 202 and generate the compensation gray value for the bright-defected pixel. (Third step S3 in FIG. 7)

The compensation gray value generated in the compensation value generator 204 is applied to the timing controller 108 as a compensation signal. The timing controller 108 enables the compensation gray value transferred as the compensation signal to be applied to the bright-defected pixel. In other words, when the OLED display device of the present disclosure is driven in the display mode, the timing controller 108 applies the compensation gray value, which is obtained in the sensing mode, to the data driver 104. As such, the bright-defected pixel can be displayed in the same as the normal pixels. (Fourth and fifth steps S4 and S5 in FIG. 7)

In this manner, the OLED display device and the driving method thereof according to the present disclosure can detect the bright-defected pixel by comparing the threshold voltages Vth of the driving transistors DT, which are sensed in adjacent pixels to one another, with one another. As such, the detection probability of the bright spot defect can become higher.

Also, the OLED display device and the driving method thereof according to the present disclosure can generate the compensation gray value for the bright-defected pixel and apply the compensation gray value to the bright-defected pixel. In accordance therewith, the deterioration of brightness at the bright-defected pixel and the normal pixels adjacent thereto can be prevented.

Moreover, the input gray value for the bright-defected pixel, which includes the driving transistor with a negatively shifted threshold voltage Vth, can be compensated on the basis of the negatively shifted degree ΔVth of the threshold voltage Vth. As such, brightness of the bright-defected pixel can be adjusted at a normal degree.

Figure 8A:
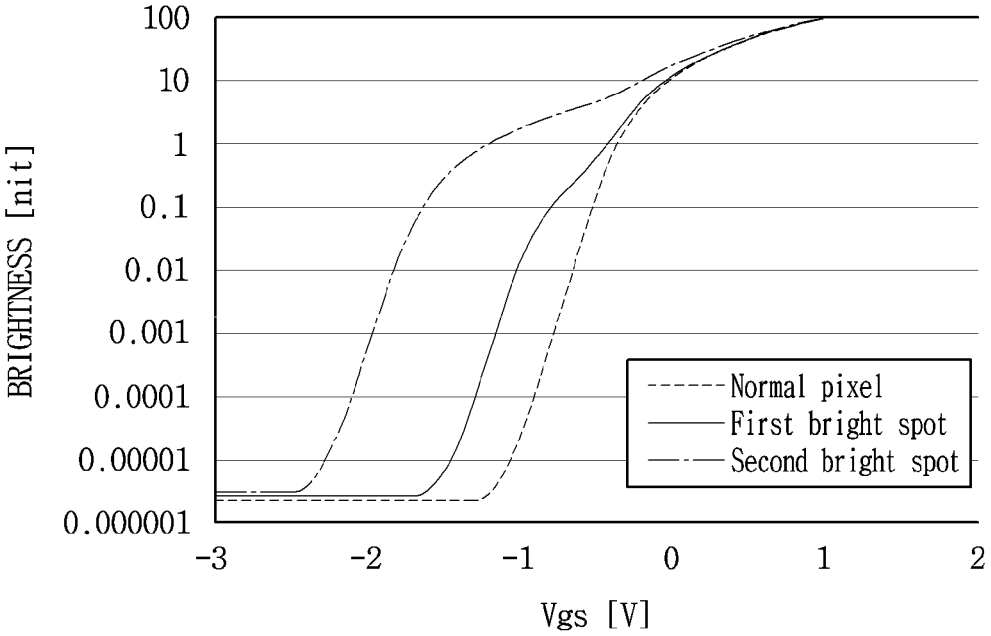
FIG. 8A illustrates brightness properties of a normal pixel and bright-defected pixels.
Figure 8B:
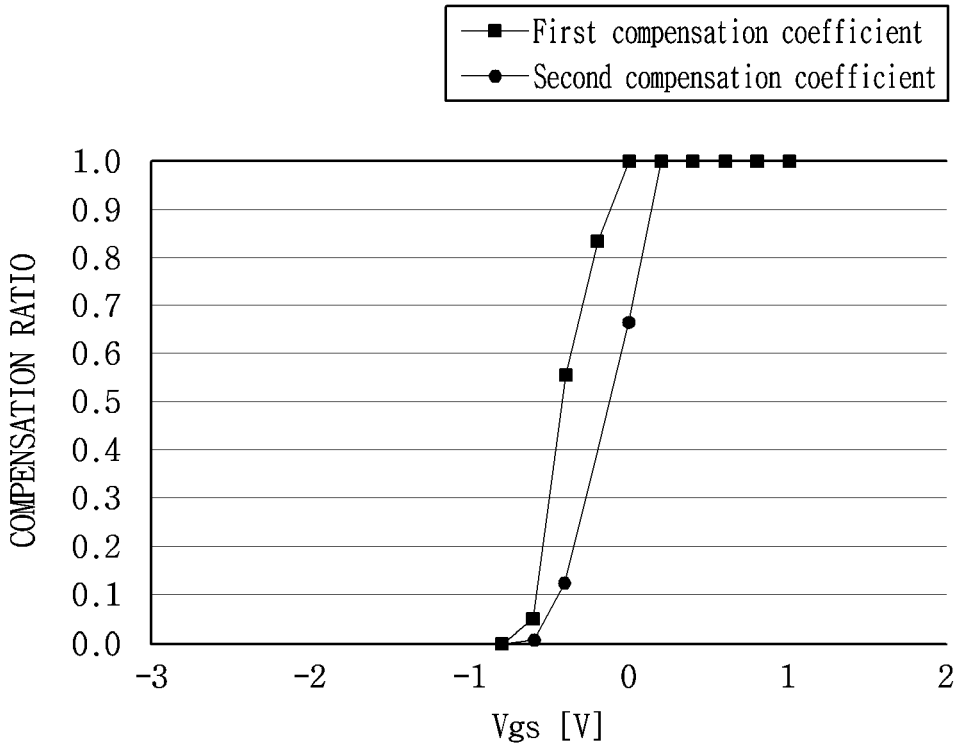
FIG. 8B illustrates brightness compensation ratio properties of bright spots.
Figure 8C:
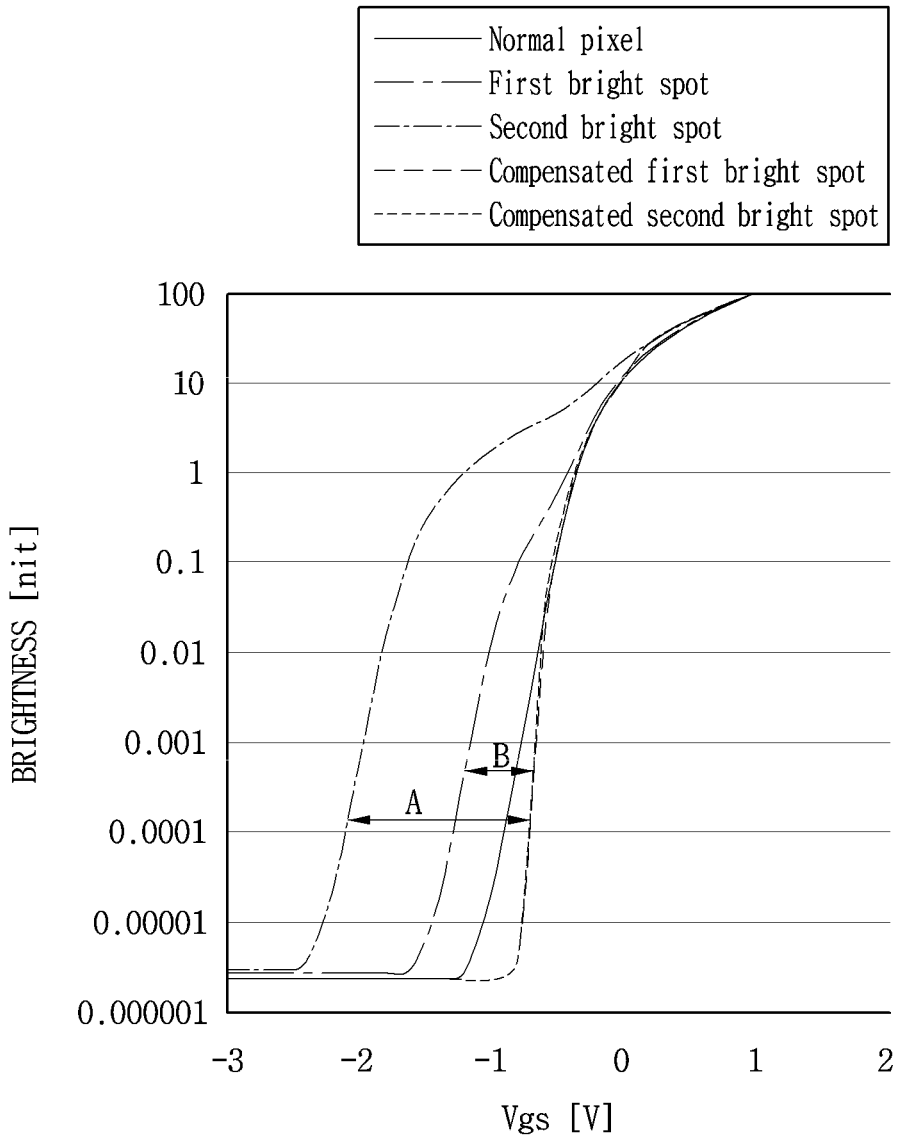
FIG. 8C illustrates brightness properties of a normal pixel, bright spots and compensated bright spots.
Figure 9A:
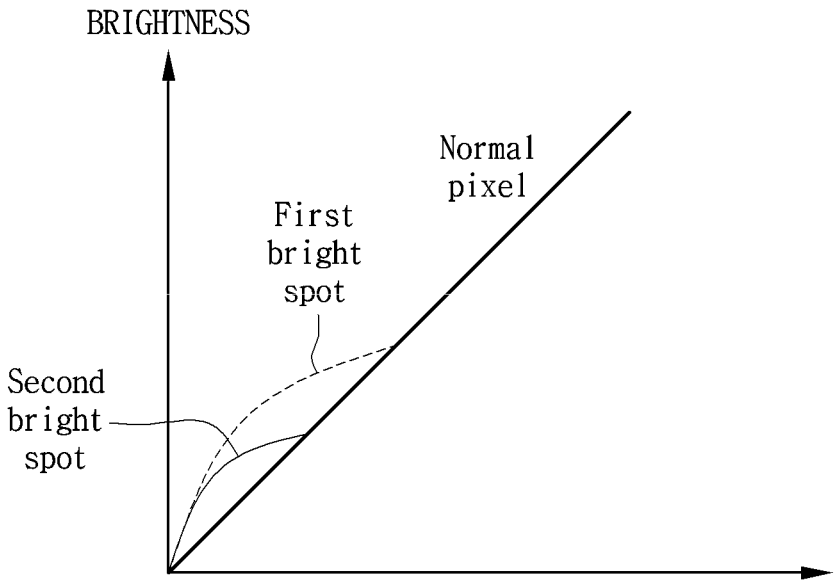
FIGS. 9A and 9B illustrate a driving principle, which allows a bright-defected pixel to be driven in the same as normal pixels, according to an embodiment of the present disclosure.
Figures 9B, 10:
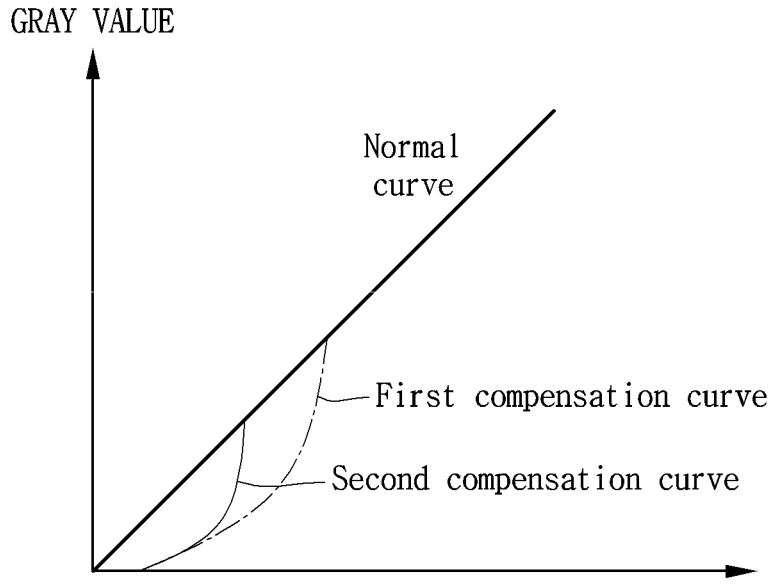
FIG. 10 is a table illustrating detection and compensation resultants of bright-defected pixel of an OLED display device according to the embodiment of the present disclosure.

FIG. 8A illustrates brightness properties of a normal pixel and bright-defected pixels. FIG. 8B illustrates brightness compensation ratio properties of bright spots. FIG. 8C illustrates brightness properties of a normal pixel, bright spots and compensated bright spots. FIGS. 9A and 9B illustrate a driving principle, which allows a bright-defected pixel to be driven in the same as normal pixels, according to an embodiment of the present disclosure. FIG. 10 is a table illustrating detection and compensation resultants of bright-defected pixels of an OLED display device according to the embodiment of the present disclosure.

As shown in FIG. 8A, first and second bright spots each have higher brightness compared to that of a normal pixel in a low range of a gate-source voltage Vgs. Such first and second bright spots result from the fact that the threshold voltages Vth of the driving transistors DT disposed in the respective pixels are negatively shifted as described above.

The OLED display device of the present disclosure can detect the bright-defected pixel by obtaining a negatively shifted degree (or a negative shift deviation) ΔVth from the sensed threshold voltage information Vth of the driving transistors DT and comparing the negatively shifted degree ΔVth with a previously set critical value.

FIG. 8B illustrates compensation ratio properties (curves) of bright spots. In FIG. 8B, a first compensation ratio property (or curve) is opposite to the first bright spot of FIG. 8A and a second compensation ratio property (or curve) is opposite to the second bright spot of FIG. 8A. As shown in FIG. 8B, the compensation ratios of the bright spots steeply increase in a gate-source voltage (Vgs) range of about −0.9~0.2 V. The first and second compensation ratio properties can compensate for the negatively shifted threshold voltages Vth of the driving transistors DT which are disposed in the bright-defected pixels corresponding to the first and second bright spots of FIG. 8A. As such, the first and second bright spots can be displayed in the same brightness as the normal pixel. In detail, the brightness properties of the first and second bright spots of FIG. 8A can be offset by the first and second compensation ratio properties of FIG. 8B through a compensation process and shifted to a brightness property range of the normal pixel as shown in FIG. 8C.

In other words, the first and second compensation ratio properties of FIG. 8B are used for compensating the brightnesses of the first and second bright spots of FIG. 8A. As such, the brightness of the first bright spot of FIG. 8A can be compensated by being offset along the first compensation ratio property of FIG. 8B. Similarly, the brightness property of the second bright spot of FIG. 8A can be compensated by being offset along the second compensation ratio property of FIG. 8B.

The above-mentioned equation 1 is derived from the first and second compensation ratio properties of FIG. 8B. In the equation 1, the first and third compensation coefficients COEF1 and COEF2 can each become a function but the third compensation coefficient COEF3 can be a constant.

Referring to FIG. 8C, the negatively shifted threshold voltage Vth of the driving transistors DT within the bright-defected pixels corresponding to the bright spots of FIG. 8A can be compensated by offsetting the brightness of the bright spots along the compensation ratio properties (or curves) of FIG. 8B which depend on the negatively shifted degrees ΔVth of the threshold voltages Vth. As such, the bright spots can be shifted to a right side of the normal pixel. In detail, the first bright spot can be shifted by a voltage width of "A" and transitioned (or moved) to a compensated first bright spot with reduced brightness. Also, the second bright spot can be shifted by another voltage width of "B" and transitioned (or moved) to a compensated second bright spot with reduced brightness.

A principle realizing such compensated bright spots will now be described with reference to FIGS. 9A and 9B.

As shown in FIG. 9A, first and second bright-defected pixels corresponding to the first and second bright spots have larger brightnesses compared to that of the normal pixel in a low gate-source voltage (Vgs) range of the driving transistor DT. The gate-source voltage Vgs can be a voltage applied between the gate and source electrodes of the driving transistor.

To address this matter, the present disclosure enables gray values of the first and second bright-defected pixels to become lower than that of the normal pixel in the low gate-source voltage (Vgs) range of the driving transistor DT, as first and second compensation curves shown in FIG. 9B. In accordance therewith, the first and second bright-defected pixels can be displayed in almost the same brightness as the normal pixel.

In other words, although the driving transistors DT of the bright-defected pixels have the negatively shifted threshold voltage Vth, the bright-defected pixels are driven by compensated gray values which are obtained from the above-mentioned equation 1. As such, the bright-defected pixels have almost the same brightness as the normal pixel. Therefore, the bright spots can be removed.

The compensation coefficients COEF1, COEF2 and COEF3 are used to inverse-compensate the gray values which are applied to the bright-defected pixels. As such, the brightnesses of the bright-defected pixels can be inverse-compensated. Therefore, the bright-defected pixels can have almost the same brightness as the normal pixel.

In the table shown in FIG. 10, a first example represents detection and compensation resultants for an OLED display device in which a small amount (or number) of bright-detected pixels are generated. In this case, 16 bright-defected white pixels and 18 bright-defected green pixels are detected. The 16 bright-defected white pixels and the 18 bright-defected green pixels are compensated by the compensation method of the present disclosure. In accordance therewith, all the 34 bright-defected pixels are displayed in the same brightness as the normal pixels. Therefore, it is evident that the bright-defected pixels can be removed from the OLED display device.

A second example represents detection and compensation resultants for an OLED display device in which a middle amount (or number) of bright-detected pixels are generated. In this case, 510 bright-defected white pixels and 597 bright-defected green pixels are detected. The 510 bright-defected white pixels and the 597 bright-defected green pixels are compensated by the compensation method of the present disclosure. As such, almost the 1107 bright-defected pixels are displayed in the same brightness as the normal pixels with the exception of some bright-defected pixel. In accordance therewith, it can be confirmed that the amount (or number) of bright-defected pixel can be reduced into a small degree.

A third example represents detection and compensation resultants for an OLED display device in which a large amount (or number) of bright-detected pixels are generated. In this case, 1870 bright-defected white pixels and 2353 bright-defected green pixels are detected. The 1870 bright-defected white pixels and the 2353 bright-defected green pixels are compensated by the compensation method of the present disclosure. As such, most of the 4223 bright-defected pixels are displayed in the same brightness as the normal pixels with the exception of a part of the bright-defected pixels. In accordance therewith, it is evident that the amount (or number) of bright-defected pixel can be reduced into a small or middle degree.

As described above, the OLED display device and the driving method thereof according to the present disclosure can detect the bright-defected pixel by comparing the threshold voltages Vth of the driving transistors DT, which are sensed in adjacent pixels to one another, with one another. As such, the detection probability of the bright spot defect can become higher.

Also, the OLED display device and the driving method thereof according to the present disclosure can generate the compensation gray value for the bright-defected pixel and apply the compensation gray value to the bright-defected pixel. In accordance therewith, the deterioration of brightness at the bright-defected pixel and the normal pixels adjacent thereto can be prevented.

Although the present disclosure has been limitedly explained regarding only the embodiments described above, it should be understood by the ordinary skilled person in the art that the present disclosure is not limited to these embodiments, but rather that the explained embodiments are considered as preferable embodiments. Accordingly, the scope of the present disclosure shall be determined only by the appended claims and their equivalents without being limited to the detailed description.

What is claimed is:

1. An organic light emitting diode display device comprising:

a display panel configured with pixels which each include an organic light emitting diode and a driving transistor applying a driving current to the organic light emitting diode;

data lines configured to provide data signals to the display panel in a display mode;

a data driver configured to apply a sensing voltage to the pixels through the data lines in a sensing mode and enable a sensing current to flow through each of driving transistors of the pixels; and a brightness compensation circuit configured to derive negatively shifted degrees of threshold voltages of the driving transistors from sensed threshold voltages corresponding to the driving currents which flow through the driving transistors, detect a bright-defected pixel on a basis of the negatively shifted degrees, and generate a compensation gray value for the bright-defected pixel.

2. The organic light emitting diode display device of claim 1, wherein the brightness compensation circuit includes:

a comparator configured to derive the negatively shifted degrees of the threshold voltages of the driving transistors from the sensed threshold voltages;

a bright spot detector configured to detect the bright-defected pixel on the basis of the negatively shifted degrees from the comparator; and a compensation value generator configured to derive the compensation gray value from an input gray value for the bright-defected pixel which is detected by the bright spot detector.

3. The organic light emitting diode display device of claim 2, wherein the bright-defected pixel is detected by comparing the negatively shifted degree with a previously set critical value.

4. The organic light emitting diode display device of claim 2, wherein the negatively shifted degree is generated by extracting a relatively high threshold voltage from the sensed threshold voltages and comparing the relatively high threshold voltage with a reference threshold voltage.

5. The organic light emitting diode display device of claim 4, wherein the relatively high threshold voltage is obtained by high-pass-filtering the sensed threshold voltages.

6. The organic light emitting diode display device of claim 4, wherein the relatively high threshold voltage is obtained by comparing the sensed threshold voltages, which are sensed from the pixels adjacent from one another, with one another.

7. The organic light emitting diode display device of claim 1, wherein the compensation gray value is obtained in the sensing mode and is applied to the bright-defected pixel through one of the data lines in a display mode which displays an image on the display panel.

8. The organic light emitting diode display device of claim 1, wherein the compensation value generator generates a compensation gray value Gray_out for the bright-defected pixel using the following equation 1:

$$\text{Gray_out}=\text{COEF1}\times\text{Gray_In}+\text{COEF2}\times f(\Delta Vth)+\text{COEF3} \quad \text{[Equation 1]}$$

wherein, in the equation 1, 'COEF1', 'COEF2' and 'COEF3' are first through third compensation coefficients, 'Gray_In' is an input gray value applied to the respective pixel before the compensation, and 'ΔVth' is a negatively shifted degree; In other words, 'ΔVth' is a deviation of the threshold voltage Vth.

9. A method of driving an organic light emitting diode display device which includes pixels each configured with an organic light emitting diode and a driving transistor applying a driving current to the organic light emitting diode, the method comprising:

sensing threshold voltages corresponding to driving currents which flow through driving transistors of the pixels;

deriving negatively shifted degrees of threshold voltages of the driving transistors from sensed threshold voltages;

detecting a bright-defected pixel on a basis of the negatively shifted degrees of the threshold voltages of the driving transistors; and generating a compensation gray value for the bright-defected pixel.

10. A method of driving an organic light emitting diode display device of claim 9, wherein the detection of the bright-defected pixel includes comparing the negatively shifted degrees of the threshold voltages with a previously set critical value.

11. A method of driving an organic light emitting diode display device of claim 9, wherein the compensation gray value is obtained in the sensing mode and is applied to the bright-defected pixel through one of the data lines when the organic light emitting diode display device is driven in a display mode.

12. A method of driving an organic light emitting diode display device of claim 9, wherein the derivation of the negatively shifted degrees includes:

extracting a relatively high threshold voltage from the sensed threshold voltages; and comparing the relatively high threshold voltage with a reference threshold voltage.

13. A method of driving an organic light emitting diode display device of claim 12, wherein the relatively high threshold voltage is obtained by high-pass-filtering the sensed threshold voltages.

14. A method of driving an organic light emitting diode display device of claim 12, wherein the relatively high threshold voltage is obtained by comparing the sensed threshold voltages, which are sensed from the pixels adjacent from one another, with one another.

15. A method of driving an organic light emitting diode display device of claim 9, wherein generating a compensation gray value for the bright-defected pixel generates a compensation gray value Gray_out for the bright-defected pixel using the following equation 1:

$$\text{Gray_out}=\text{COEF1}\times\text{Gray_In}+\text{COEF2}\times f(\Delta Vth)+\text{COEF3} \quad \text{[Equation 1]}$$

wherein, in the equation 1, 'COEF1', 'COEF2' and 'COEF3' are first through third compensation coefficients, 'Gray_In' is an input gray value applied to the respective pixel before the compensation, and 'ΔVth' is a negatively shifted degree; In other words, 'ΔVth' is a deviation of the threshold voltage Vth.

* * * * *